United States Patent [19]

Fluck et al.

[11] 4,237,686

[45] Dec. 9, 1980

[54] FALSE TWISTING APPARATUS

[75] Inventors: Jakob Fluck; Hans Schellenberg, both of Winterthur, Switzerland

[73] Assignee: Maschinenfabrik Rieter AG, Winterthur, Switzerland

[21] Appl. No.: 16,511

[22] Filed: Mar. 1, 1979

[30] Foreign Application Priority Data

Mar. 3, 1978 [CH] Switzerland ..... 2324/78

[51] Int. Cl.[3] ..... D02G 1/04; D01H 7/92

[52] U.S. Cl. ..... 57/337

[58] Field of Search ..... 57/334, 337, 338, 339, 57/340, 343, 352

[56] References Cited

U.S. PATENT DOCUMENTS

| | | | |
|---|---|---|---|
| 3,762,149 | 10/1973 | Raschle | 57/339 |
| 3,854,276 | 12/1974 | Marzoli | 57/339 |
| 3,942,313 | 3/1976 | Gassner et al. | 57/339 |
| 3,998,041 | 12/1976 | Graf | 57/337 |
| 4,010,599 | 3/1977 | Lüthi | 57/334 |
| 4,027,467 | 6/1977 | Smith | 57/337 X |

*Primary Examiner*—Donald Watkins

*Attorney, Agent, or Firm*—Werner W. Kleeman

[57] ABSTRACT

The present invention concerns a false twist apparatus (1) with friction discs (3) arranged at mutual distances on a shaft (2) and with thread guides (4) extending to between the discs (3), for imparting twist to a thread (11) guided friction-contactingly over the friction discs by the thread guides. The thread guides in this arrangement are provided with a concave curvature, as seen with respect to the direction of movement of the twist imparting surface (F).

7 Claims, 3 Drawing Figures

FALSE TWISTING APPARATUS

From U.S. Pat. No. 3,998,041 pin-shaped thread guides, called thread guide pins therein, are known to extend between the friction discs of a false twist imparting device in such manner that a so-called wedge effect acts onto the thread, which generates an additional contacting pressure force of the thread on the friction imparting element or disc and thus improves the frictional contact between the thread and the friction disc, and consequently generates increased twist in the thread. The increased twist, on the other hand causes the thread to roll further along the thread guide surface, due to the friction between the thread and the thread guide surface, until the forces generated by the thread tension and the opposite force generated by the rolling of the thread are balanced. As this further rolling of the thread increases the thread tension further, however, a thread breakage may be caused, according to the force relation of the thread tension and the rolling force, which depends on the setting angle of the thread guide relative to the disc.

It thus is the object of the present invention to propose a method of imparting twist, and a false twisting apparatus utilizing the advantage of the wedge effect without the danger of thread breakage, in that the rolling movement of the thread on the thread guide, caused by the frictional force between the thread and the thread guide generated by the twist imparted to the thread, continues only to the point at which the resulting thread tension remains below the breaking tension.

This object is achieved by the invention in which false twisting apparatus comprising at least one twist element movable in a predetermined twisting direction and having a surface adapted to impart twist to a thread by a frictional contact therewith and at least one elongate thread guide having a thread surface extending along said thread guide and support means supporting the thread guide relative to the twist element so that a thread contacting said surface on the twist element and twisted thereby, also contacts said thread guide and is urged along the thread guide surface, the thread guide surface being provided with a curvature which is concave with respect to said direction.

By choosing individual thread guides of different curvature and by choosing the setting angle $\alpha$ of the guides relative to the twist elements, the thread tension from the entry of the thread into the twist imparting device to the exit of the thread is adaptable to the requirements, i.e. variable.

Figure 1:
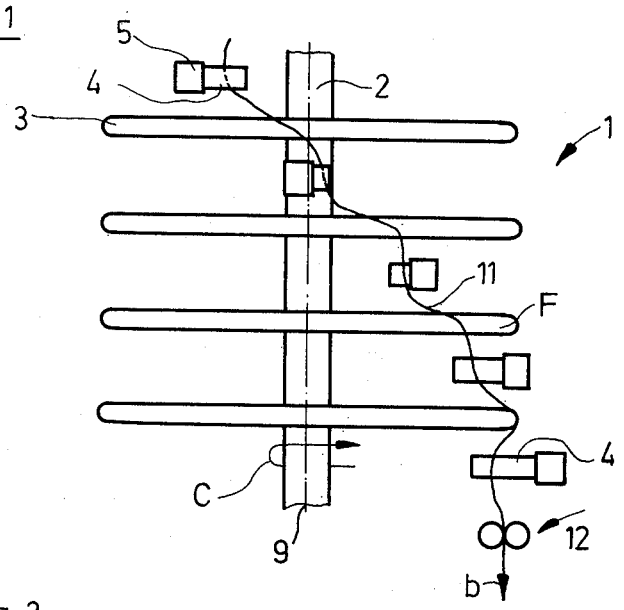
Figure 2:
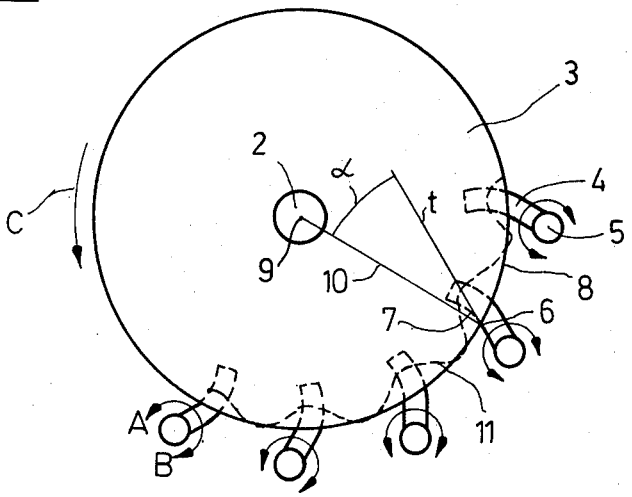
Figure 3:
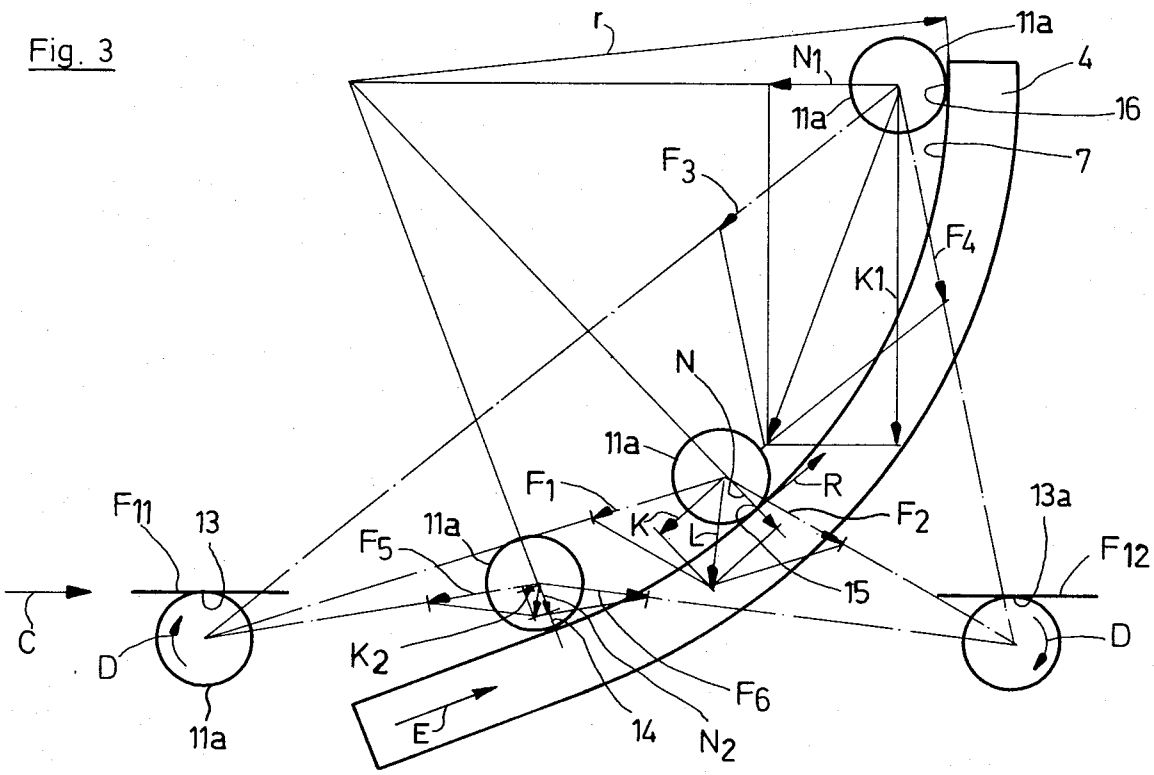

The invention is described in more detail in the following with reference to illustrated design examples. There is shown in:

FIG. 1 a false twisting apparatus, shown in a simplified and semi-schematic lateral view, FIG. 2 a top view of the false twisting apparatus according to FIG. 1, FIG. 3 a schematic view of a part of the false twisting apparatus.

The false twisting apparatus 1 comprises a drive shaft 2 on which friction discs 3 are rigidly mounted and of thread guides 4. Each thread guide 4 is mounted on an individual shaft 5, the shafts being distributed around the periphery of the discs as viewed in FIG. 2. From its shaft 5, each guide extends generally inwardly of the discs to lie above, and below, respectively, the discs 3. The drive shaft 2 and the shafts 5 are rotatably supported in a console (not shown). Owing to the rotatability of the shafts 5 in the direction of arrow A, or of arrow B (FIG. 2) respectively, adaptability of the setting angle $\alpha$ is achieved. The setting angle $\alpha$ is enclosed, as seen in a projection of the twist imparting device in the direction of the rotational axis, by a tangent line t through the intersection point 6 of the curved thread guide surface 7 and of the circumferential outline 8 of the friction discs 3, and by a straight line 10 connecting the rotational axis 9 of the twist imparting device and the intersection point 6.

A thread 11 contacting the friction discs 3 and guided by the surfaces 7, moving down from above in the direction of arrow b (FIG. 1) is transported by a supply device 12 of a type known as such arranged after the last thread guide 4. The terms "upper, and above" and "lower, and below" in this context are not to be understood as related to the position of the twist imparting device 1 with respect to the surrounding room, but as related to the direction b of the thread movement mentioned.

In FIG. 3 a thread guide 4 is shown schematically and enlarged. The friction surface F (also called twist imparting surface) of the friction discs 3 is indicated as unfolded into a straight line F11 or F12 respectively, the unfolded line F 11 indicating the friction surface of the friction disc above the thread guide 4 i.e. the surface first contacted along the portion of the thread path shown in FIG. 3, and the unfolded line F 12 indicating the friction surface of the friction disc below the thread guide 4. The thread 11 (FIGS. 1 and 2) guided from the upper friction surface (F 11) via the thread guide surface 7 to the lower friction surface (F 12) is indicated at the corresponding contact points 13 and 13*a* respectively with a circle 11*a* each.

At the contact points 13 and 13*a* twist is imparted to the thread 11*a* on the straight lines F11 and F12 in the direction of arrow D, owing to the direction of movement C.

This twist causes at the contact point 14 on the thread guide surface 7, owing to the friction between the thread 11 and this surface 7, a rolling movement of the thread 11*a*, along the guide surface 7 in the direction of arrow E, until e.g. at the contacting point 15 the force K, resulting indirectly from the thread tension forces F1 and F2 respectively, offsets the opposite friction force R. The friction force R results from the normal force N and the frictional coefficient between the thread 11*a* and the guide surface 7. From the parallelogram of forces indicated in FIG. 3, the force K and the normal force N required for the friction force R are deducted from the force L which results from the forces F1 and F2.

The length of the threaded guide surface 7, which is curved with the radius r, and the radius r itself, can be chosen such, that at any chosen setting angle $\alpha$ of the thread 11*a* it is ensured that no contacting point is reached at which a thread breakage would occur.

The radius r in this arrangement is to be chosen in the range of 10 mm or more.

That the further rolling of the thread on the thread guide surface can be limited using a curved thread guide surface, can be shown with reference to the force relations at the practically unreachable contact point 16. If under the given force relations the normal force N1 is derived, it is found to be negative, which indicates that in such a position the thread would be lifted off.

This signifies that the normal forces N2, N and N1, and thus the friction forces which are proportional thereto as a function of the length of the guide surface 7 first show an increase and subsequently become, as shown for the contact point 16, negative, i.e. finally tend towards zero.

The characteristics of the force K2, and K, and K1 respectively, which counteract the corresponding friction forces, as a function of the length of the thread guide surface 7 show an increase of counteracting force.

The "operational contact point" of the thread thus is established at the position where the force K equals the friction force R.

Furthermore it is to be noted that the thread tension forces F1 through F6 have been chosen freely, but in correspondence to practical use, as consecutively increasing, but taking account of the—as explained above—unattainable forces F3 and F4.

As differing from the illustration shown in FIG. 2, in which all thread guides 4 are arranged under substantially the same setting angle $\alpha$, there is the possibility to influence the thread tension differently at each stage, from one disc 3 to the next disc 3, by applying a different setting angle $\alpha$.

The type of the adjustability of the thread guides 4 is known as such from West German Patent No. 2,609,808 (equivalent of U.S. Pat. No. 3,998,041, and of Belgian Patent No. 845,916) and thus is not described further in this context.

I claim:

1. False twisting apparatus comprising at least one twist element movable in a predetermined twisting direction and having a surface adapted to impart twist to a thread by frictional contact therewith and at least one elongate thread guide having a thread surface extending along said thread guide, support means supporting the thread guide relative to the twist element so that a thread contacting said surface on the twist element and twisted thereby, also contacts said thread guide and is urged along the thread guide surface, the latter being provided with a curvature which is concave with respect to said direction.

2. False twisting apparatus comprising at least one moving twist imparting surface and at least one pin-shaped thread guide extending above, or below respectively, under a setting angle, with a thread guide surface for frictionally guiding a thread contacting the circumference of the twist imparting surface for twist impartion, said thread guide surface being provided with a concave curvature with respect to the direction of movement of the twist imparting surface in the range of 10 mm or more.

3. False twisting apparatus according to claim 1, wherein the thread guide is pivotable on said support means.

4. False twisting apparatus according to claim 3, wherein said twist element is one of a plurality of friction discs and said thread guide is one of a corresponding number of coordinated thread guides the setting of which relative to the discs can be chosen by pivoting the guides on the support means.

5. False twisting apparatus according to claim 2, wherein the curvature of the individual thread guides is different.

6. False twisting apparatus according to claim 1, wherein the radius of the curvature is in the range of 10 mm or more.

7. False twisting apparatus according to claim 4, wherein the curvature of the individual thread guides is different.

* * * * *